US010438788B2

(12) United States Patent
Murphy

(10) Patent No.: US 10,438,788 B2
(45) Date of Patent: Oct. 8, 2019

(54) SYSTEM AND METHODOLOGY FOR EXPRESSING ION PATH IN A TIME-OF-FLIGHT MASS SPECTROMETER

(71) Applicant: NOAA Technology Partnerships Office, Silver Spring, MD (US)

(72) Inventor: Daniel Murphy, Boulder, CO (US)

(73) Assignee: NOAA Technology Partnerships Office, Silver Spring, MD (US)

( * ) Notice: Subject to any disclaimer, the term of this patent is extended or adjusted under 35 U.S.C. 154(b) by 0 days.

(21) Appl. No.: 16/186,821

(22) Filed: Nov. 12, 2018

(65) Prior Publication Data

US 2019/0096653 A1 Mar. 28, 2019

Related U.S. Application Data

(63) Continuation of application No. 15/701,430, filed on Sep. 11, 2017, now Pat. No. 10,128,098, which is a continuation of application No. 15/249,370, filed on Aug. 27, 2016, now Pat. No. 9,761,431.

(60) Provisional application No. 62/221,389, filed on Sep. 21, 2015.

(51) Int. Cl.
*H01J 49/00* (2006.01)
*H01J 49/40* (2006.01)

(52) U.S. Cl.
CPC ..... *H01J 49/408* (2013.01)

(58) Field of Classification Search
CPC ..... H01J 49/408
USPC ..... 250/287
See application file for complete search history.

(56) References Cited

U.S. PATENT DOCUMENTS

| | | | | |
|---|---|---|---|---|
| 6,300,625 | B1 * | 10/2001 | Ishihara | H01J 49/408 250/287 |
| 6,867,414 | B2 * | 3/2005 | Buttrill, Jr. | H01J 49/408 250/281 |
| 7,355,168 | B2 * | 4/2008 | Yamaguchi | H01J 49/282 250/282 |
| 8,013,292 | B2 * | 9/2011 | Nishiguchi | H01J 49/408 250/281 |
| 9,761,431 | B2 * | 9/2017 | Murphy | H01J 49/408 |
| 2008/0006768 | A1 * | 1/2008 | Yamaguchi | H01J 49/408 250/287 |

* cited by examiner

*Primary Examiner* — Michael Maskell
(74) *Attorney, Agent, or Firm* — Raymond Van Dyke; Van Dyke Law

(57) ABSTRACT

A system for expressing an ion path in a time-of-flight (TOF) mass spectrometer. The present invention uses two successive curved sectors, with the second one reversed, to form S-shaped configuration such that an output ion beam is parallel to an input ion beam, such that the ions makes two identical but opposed turns, and such that the geometry of the entire system folds into a very compact volume. Geometry of a TOF mass spectrometer system in accordance with embodiments of the present invention further includes straight drift regions positioned before and after the S-shaped configuration and, optionally, a short straight region positioned between the two curved sectors with total length equal to about the length of the central arc of both curved sectors.

21 Claims, 5 Drawing Sheets

SYSTEM AND METHODOLOGY FOR EXPRESSING ION PATH IN A TIME-OF-FLIGHT MASS SPECTROMETER

CROSS REFERENCE TO RELATED APPLICATION

The present invention is a continuation of non-provisional U.S. patent application Ser. No. 15/701,430, entitled "SYSTEM AND METHODOLOGY FOR EXPRESSING ION PATH IN A TIME-OF-FLIGHT MASS SPECTROMETER," filed Sep. 11, 2017, now U.S. Pat. No. 10,128,098, which is a continuation of non-provisional U.S. patent application Ser. No. 15/249,370, entitled "SYSTEM AND METHODOLOGY FOR EXPRESSING ION PATH IN A TIME-OF-FLIGHT MASS SPECTROMETER," filed Sep. 21, 2015, now U.S. Pat. No. 9,761,431, which claims priority to U.S. Patent Application Ser. No. 62/221,389, entitled "SYSTEM AND METHODOLOGY FOR EXPRESSING ION PATH IN A TIME-OF-FLIGHT MASS SPECTROMETER," filed Sep. 21, 2015, the subject matters of which are incorporated by reference herein.

STATEMENT REGARDING FEDERAL RIGHTS

The invention described herein was made with support from the National Oceanic and Atmospheric Administration (NOAA) of the United States Department of Commerce. The United States Government has certain rights in the invention.

FIELD OF THE INVENTION

The present disclosure relates generally to a mass spectrometer, and more particularly, to a time-of-flight mass spectrometer having a compact geometry with low aberrations.

BACKGROUND OF THE INVENTION

A time-of-flight (TOF) mass spectrometer has become a powerful analytical tool that provides a simple and easy method to obtain exact mass measurements. Its characteristic features are high sensitivity, theoretically infinite mass-range, and rapid measurements. These features give the TOF mass spectrometer a great advantage over other mass spectrometers, such as the quadrupole, ion trap, magnetic sector-type mass spectrometers, and the like. However, TOF mass spectrometers need special design features to attain the resolving power necessary for accurate mass analysis.

A TOF mass spectrometer comprises at least three major components: an ion source, a free-flight region, and an ion detector. In the ion source, molecules from the sample are converted to volatile ions, usually by high-energy bombardment, each ion being characterized by its mass-to-charge ratio, or m/z.

Following ionization, ions of appropriate polarity are accelerated to a final velocity by an electric field and enter the free-flight region. This acceleration and extraction imparts a kinetic energy to each of the ions, and each ion acquires a final velocity after acceleration that is inversely proportional to the square root of its mass. Accordingly, lighter ions have a higher velocity than heavier ions.

During free-flight, ions of different masses separate as a consequence of their different velocities. After traversing the free-flight region, the ions arrive at the ion detector component. The time taken by an ion to traverse this distance, known as the time-of-flight (TOF), may be used to calculate the mass of the ion. In this manner, a time-of-flight spectrum may be converted into a mass spectrum of the original sample.

Mass resolution of a TOF mass spectrometer is expressed as $t/2\Delta t$, where t is the total time of flight, which is given by the flight path length divided by the ion velocity, and $\Delta t$ is the peak width measured at full width at half maximum (FWHM). Accordingly, extending the flight path length and minimizing the peak width is particularly effective to improve the mass resolution. However, elongation of a flight distance on a straight line results in enlargement of the device. The peak width depends on the broadening of the ion packet at the detector, especially along the velocity axis and the response time of the detector. Various ion optical techniques have been reported to minimize the peak width: space focusing; time-lag focusing; orthogonal acceleration; and an ion mirror or sector fields.

Most commercial TOF mass spectrometers are based on linear or reflectron ion optics. Their flight path lengths are often one to several meters and they depend on the size of the instrument. Thus, the method by which the flight path length can be increased to a length much greater than the instrument size is crucial for the improvement of mass resolution and mass accuracy.

Multi-turn TOF mass spectrometers using electrostatic sector fields have been proposed as a solution to increase flight length without drastically increasing instrument size. In this type of spectrometer, the flight path length is not restricted to the instrument size and can be increased because the ions revolve around a closed orbit. Multi-turn TOF mass spectrometers have been constructed: a large multi-turn TOF mass spectrometer comprising six electrostatic analyzers that produces an elliptical orbit; and a compact multi-turn TOF mass spectrometer consisting of four cylindrical electrostatic sectors, 16 electrostatic quadrupole lenses, and providing a figure-eight-shaped ion orbit having a shorter flight path length. The design was further compacted by utilizing four toroidal electrostatic sectors and four cylindrical electrostatic sectors.

A multi-turn TOF mass spectrometer has "overtaking" problems. Because ions having different mass (m) to charge (z) ratios revolve in the closed orbit repeatedly, the faster ions with smaller m/z values pass the slower ones with larger m/z values. As a result, ions with different m/z values do not arrive at an ion detector in the order of their m/z value. Certain complex mathematical treatments are then required to transform the deformed mass spectrum into one that is of the order of the m/z value. Some proposals to avoid such complex mathematical treatments include the use of a spiral trajectory so that ions travel for approximately fewer cycles along a helical ion trajectory or the use of complicated electrical gating to only let ions in a small mass range enter the multi-turn path.

Single path TOF spectrometers have followed two main design patterns to achieve reasonable mass accuracy when the ions have a spread in initial energy: "Reflectron" designs, in which electrodes arranged in a nearly linear fashion, turn the ion beam nearly back upon itself in a controlled fashion; and "Sector" designs, in which electrodes are sections of cylinders, toroids or similar shapes, turn the ion beam through a nearly circular arc with a specific angle.

To realize a high ion transmission, mass resolution and mass accuracy, broadening of the ion packet must be minimized not only along the velocity axis but also along the axes perpendicular to the velocity axis. Several sector designs have been proposed with focusing properties along these axes. These designs focus an input slit onto an exit slit. However, overall geometry of such designs is inconvenient. The output beam is at an odd angle relative to the input beam. Most designs require a large vacuum chamber relative to the length of the ion path. In addition, every sector must be paired with a straight section of a specific length immediately before and after each sector. One multi-turn sector design included special ion optics to compensate for straight sections that were not the optimal length for that geometry.

Accordingly, it is desirable to provide apparatus and methods for performing TOF mass spectrometry with improved mass resolution and/or the sensitivity of mass spectra, in which the output ion beam is parallel to the input ion beam, there is more flexibility in positions of the source and detector, the entire geometry folds into a very compact volume, and certain higher-order aberrations cancel when the ion beam makes turns.

SUMMARY OF THE INVENTION

The present invention provides apparatus and methods for performing TOF mass spectrometry with improved mass resolution and/or the sensitivity of mass spectra, in which the output ion beam is parallel to the input ion beam, there is more flexibility in positions of the source and detector, the entire geometry folds into a very compact volume, and certain higher-order aberrations cancel when the ion beam makes turns. Accordingly, embodiments of the present invention relates to a system for expressing an ion path in a time-of-flight mass spectrometer, which comprise: a first straight sector defining a first straight ion flight path, said first sector having a first sector entrance and a first sector outlet, wherein the first sector entrance is positioned to receive a plurality of ions along the first straight ion flight path; a first electric sector defining a first curved ion flight path, said first electric sector having a first electric sector entrance and a first electric sector outlet, wherein the first electric sector entrance is positioned opposing the first straight sector outlet and to receive the plurality of ions from the first straight sector outlet along the first curved ion flight path; a second electric sector defining a second curved ion flight path, said second electric sector having a second electric sector entrance and a second electric sector outlet, wherein the second electric sector entrance is positioned opposing the first electric sector outlet and to receive the plurality of ions exiting from the first electric sector outlet along the second curved ion flight path; and a second straight sector defining a second straight ion flight path, said second sector having a second sector entrance and a second sector outlet, wherein the second sector entrance is positioned to receive the plurality of ions from the second electric sector outlet along the second straight ion flight path.

Embodiments of the system in accordance with the present invention further comprise an ion source for generating the plurality of ions and an ion detector for detecting the plurality of ions exiting the second straight sector, wherein the ion detector is positioned to receive the plurality of ions from the second straight sector outlet. More particularly, the plurality of ions are generated as a pulse of ions.

In one aspect of the present invention, each of the first and second electric sectors comprises an inner deflecting electrode and an outer deflecting electrode. More particularly, each of the first and second electric sectors comprising the inner deflecting electrode and the outer deflecting electrode define a deflection angle of about 254.5 degrees.

In another aspect of the present invention, the second electric sector is positioned to define the second curved ion flight path opposing the first curved ion flight path. More particularly, the first and the second curved ion flight paths define a S-shaped ion flight path.

In yet another aspect of the present invention, the ion source, the first and second straight sections, the first and second electric sectors, and the ion detector are positioned to constrain the plurality of ions to traverse a helical ion flight path.

Some embodiments of the present invention further comprise a third straight sector defining a third straight ion flight path, said third sector having a third sector entrance and a third sector outlet, wherein the third sector entrance is positioned to receive ions from the first electric sector outlet along the third straight flight path, wherein the second electric sector entrance is positioned to receive the plurality of ions exiting from the third straight sector outlet along the second curved ion flight path.

In one embodiment of the present invention, the first straight sector further comprises an adjustable sector for adjusting effective length of the first straight sector. In another embodiment of the present invention, the system further comprises a plurality of optical lenses positioned at the first sector entrance for reducing divergence of the plurality of ions generated from the ion source.

In other embodiments of the present invention, the system further comprises a first slit positioned at the first sector entrance and a second slit positioned at the second sector outlet, wherein the first and second slits limit the plurality of ions to comprise ions having substantially identical ion flight paths.

Another embodiment of the present invention relates to a system for expressing an ion path in a time-of-flight mass spectrometer, which comprises: a plurality of field free sectors defining a plurality of straight ion flight paths, wherein each field free sector comprises a sector entrance and a sector outlet, wherein the at least one of the plurality of field free sector entrance is positioned to receive a plurality of ions along the at least one of the plurality of straight ion flight path; at least two electric sectors positioned to define a first and a second curved ion flight paths, wherein the first curved ion flight path opposes the second curved ion flight path to define a S-shaped ion flight path, and wherein the at least two electric sectors are positioned to enable the plurality of ions to travel along the S-shaped ion flight paths. More particularly, each of the at least two electric sectors comprises an inner deflecting electrode and an outer deflecting electrode. In one embodiment of the present invention, the system further comprises an ion source for ionizing chemical compounds to form the plurality of ions, and an ion detector for detecting the plurality of ions that have traveled along the plurality of straight ion flight paths and the first and second curved ion flight paths, wherein the ion detector is positioned to receive the plurality of ions exiting from the at least one of the plurality of free field sector outlets.

In one aspect of the present invention, each of the at least two electric sectors comprises an electric sector entrance and an electric sector outlet.

In one embodiment of the present invention, the system further comprises at least one electrode for modifying potential experienced by the ions entering the at least one of the plurality of field free sectors from the ion source.

In another embodiment of the present invention, the system further comprises a first optical element disposed at the sector entrance of the at least one of the plurality of field free sector entrance receiving the plurality of ions and a second ion optical element disposed at the sector outlet exiting the ions from the at least one of the plurality of free field sector outlets.

Some embodiments of the present invention further comprise a device for recording a time-of flight spectrum of the detected ions.

BRIEF DESCRIPTION OF THE DRAWINGS

While the specification concludes with claims particularly pointing out and distinctly claiming the subject matter that is regarded as forming the present invention, it is believed that the invention will be better understood from the following description taken in conjunction with the accompanying DRAWINGS, where like reference numerals designate like structural and other elements, in which:

DETAILED DESCRIPTION OF THE PRESENT INVENTION

The present invention will now be described more fully hereinafter with reference to the accompanying DRAWINGS, in which preferred embodiments of the invention are shown. It is, of course, understood that this invention may, however, be embodied in many different forms and should not be construed as limited to the embodiments set forth herein; rather, these embodiments are provided so that the disclosure will be thorough and complete, and will fully convey the scope of the invention to those skilled in the art. It is, therefore, to be understood that other embodiments can be utilized and structural changes can be made without departing from the scope of the present invention.

Embodiments of the present invention relates to a system for expressing an ion path in a time-of-flight (TOF) mass spectrometer. The present invention provides a highly efficient system as an alternative to existing devices for mass measurements. The present invention uses two successive curved sectors, with the second one reversed, to form S-shaped configuration such that an output ion beam is parallel to an input ion beam and geometry of the entire system folds into a very compact volume. Further, certain higher-order aberrations cancel when the ion beam makes two identical but opposed turns (e.g. a right-hand turn followed by a left-hand turn or a left-hand turn followed by a right-hand turn). Geometry of a TOF mass spectrometer system in accordance with embodiments of the present invention includes: (a) two electrostatic curved sectors, with each curved sector having a deflection angle of about 254.5 degrees (pi divided by the square root of two radians), in an S-shaped configuration; (b) Straight drift regions with total length equal to about the length of the central arc of both sectors—a straight region can be positioned before and after the S-shape and, optionally, a short straight region can be positioned between the two halve of the S-shape; (c) Entrance and exit slits; (d) optional shims or plates at the slits or the top and bottom of the sector electrodes to provide fine control of the electric fields; and (e) optional ion optics to focus ions (or other charged particles), correct for imperfections, and speed up or delay ions to adjust the effective length of the straight regions.

Figure 1:
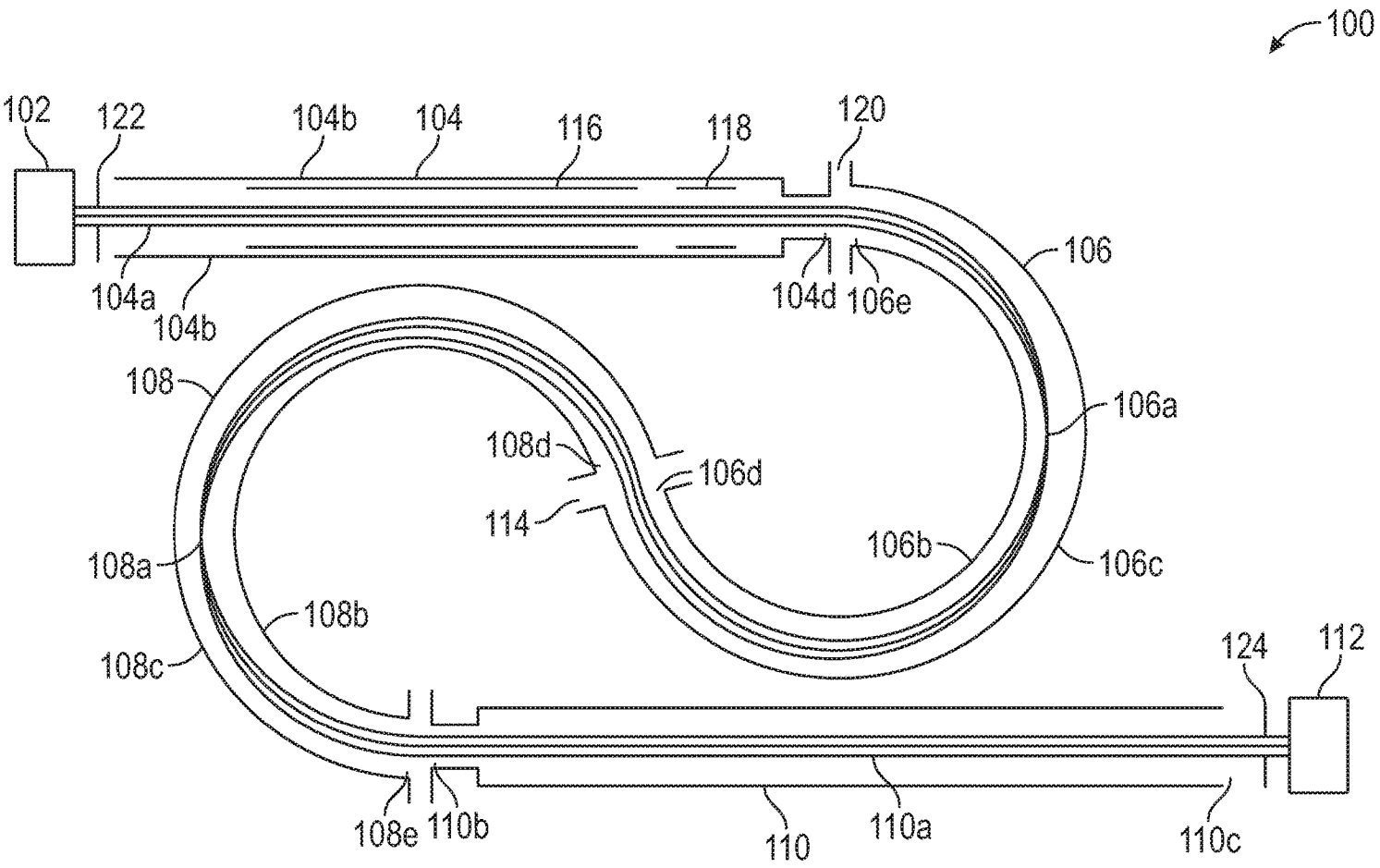
FIG. 1 illustrates a system for expressing an ion path in a time-of-flight (TOF) mass spectrometer in accordance with an embodiment of the present invention.

Referring now to the drawings, and more particularly, to FIG. 1, there is shown a system for expressing an ion flight path in a TOF mass spectrometer, generally designated 100, which comprises embodiments of the present invention. TOF mass spectrometer system 100 includes ion source 102, entrance straight section 104, curved electric sector 106, curved electric sector 108, exit straight section 110, and detector 112.

Ion source 102 includes means or methods known in the art for ionizing chemical compounds to generate charged molecules or molecule fragments. Ion source 102 may also include means or methods known in the art for forming ions in a continuous or pulsed manner such that the pulse of ions has the appearance of or behaves as if the ions were produced within a relatively small volume and within a relatively short time.

Ion source 102 may, e.g., include means that employ a pulsed laser interacting with a solid surface, a pulsed focused laser ionizing a gas within a small volume, or a pulsed electron or ion beam interacting with a gas or solid surface. In another example, ion source 102 may employ means for generating a pulse of ions that uses a rapidly sweeping, continuous ion beam passed over a narrow slit, in which a brief pulse of ions is produced by the ions passing through the slit when the ion beam passes thereover. Ion source 102 may employ, but is not limited to use of, electrospray ionization, laser desorption/ionization ("LDI"), matrix-assisted laser desorption/ionization ("MALDI"), surface-enhanced laser desorption/ionization ("SELDI"), surface-enhance neat desorption ("SEND"), fast atom bombardment, surface-enhanced photolabile attachment and release, pulsed ion extraction, plasma desorption, multiphoton ionization, electron impact ionization, inductively coupled plasma, chemical ionization, atmospheric pressure chemical ionization, hyperthermal source ionization, and the like.

Ion source 102 also includes means for ion extraction or acceleration from the ion source to ion entrance 104*d* of the ion flight path. The extraction methods may be parallel or orthogonal to the ion beam generated in ion source 102. In addition, extraction or acceleration of the ions may occur subsequent to the formation of the ions, such as by application of a voltage pulse.

Figure 3:
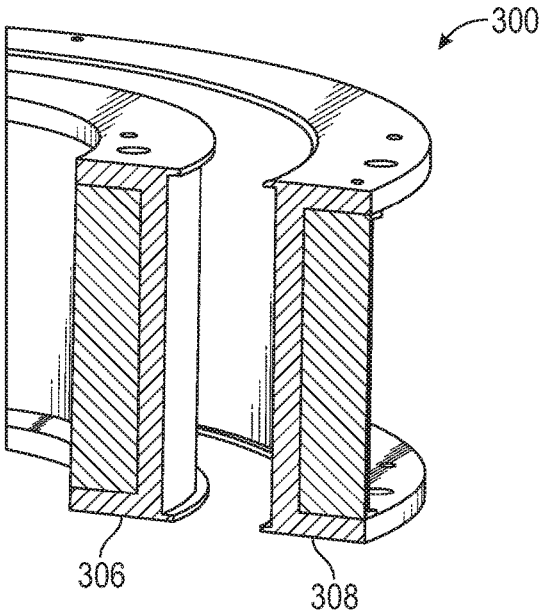
FIG. 3 illustrates an alternate view of the inner and outer electrodes of a TOF mass spectrometer system in accordance with one embodiment of the present invention.
Figure 4:
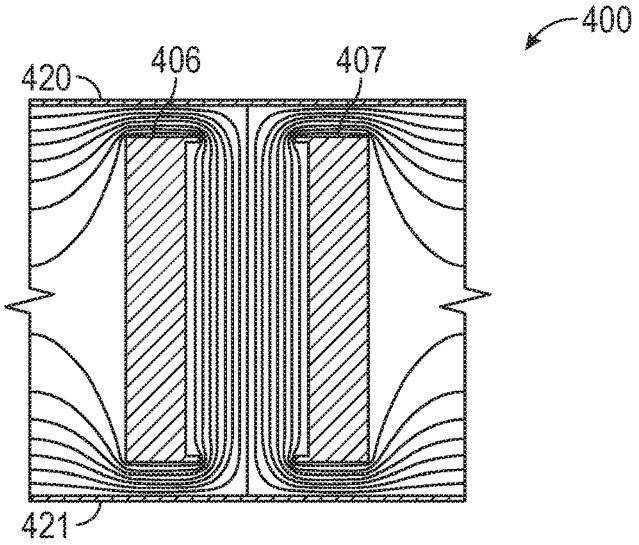
FIG. 4 illustrates equipotential surfaces for an exemplary cross-section of the inner and outer electrodes of a TOF mass spectrometer system in accordance with one embodiment of the present invention.

TOF mass spectrometer system 100 comprises an open ion flight path formed by curved ion flight paths 106*a* and 108*a* and straight ion flight paths 104*a* and 110*a*. Curved paths 106*a* and 108*a* are within curved electric sectors 106 and 108, respectively. As shown in FIG. 1, electric sector 106 includes an inner deflecting electrode 106*b* and an outer deflecting electrode 106*c* and electric sector 108 includes an inner deflecting electrode 108*b* and an outer deflecting electrode 108*c*. In one embodiment of the present invention, deflecting electrodes 106*b-c* and 108*b-c* are cylindrical sections with outer electrodes 106*c* and 108*c* having a larger radius than inner electrodes 106*b* and 108*b*. Alternatively, electrodes 106*b-c* and 108*b-c* may conform to other forms, such as toroidal or spherical sections in which the radii of inner and outer electrodes are substantially the same and hence converge at the top and bottom. In some embodiments of the present invention, inner electrodes 106*b* and 108*b* and outer electrodes 106*c* and 108*c* have forms providing partial closure at the top and bottom, as shown in FIG. 3, with an inner electrode 306 and an outer electrode 308. The partial closure allows the overall design to be thinner and provides improved uniformity of electric fields between the curved electrodes, as shown in FIG. 4. FIG. 4 shows the calculated equipotential surfaces for an exemplary cross-section with ground plates above and below.

In one embodiment of the present invention, curved paths 106*a* and 108*a* are formed with cylindrical electrodes and deflection angles of about 254.5 degrees, respectively. In another embodiment of the present invention, curved paths 106*a* and 108*a* are formed with "y-focusing" electrodes having deflection angles greater than 254.5 degrees. In one embodiment of the present invention, curved paths 106*a* and 108*a* are formed with "y-focusing" electrodes having deflection angles of about 257 degrees, respectively. "Y-focusing" refers to techniques for controlling the spread of ions along the axis perpendicular to the plane defined by straight sections 104 and 110 and curved electric sectors 106 and 108. Exemplary methods of varying "y-focusing" features include use of toroidal or spherical electrodes instead of cylindrical electrodes, varying the voltages on the plates above and below the sector electrodes, generally designated by the reference numerals 406 and 407, respectively, shown as top and bottom plates (not at ground) in FIG. 4, generally designated by the reference numeral 420 and 421, respectively, and the like. Mass resolution and ion transmission can be improved by optimizing certain design elements in the plane defined by straight sections 104 and 110 and curved electric sectors 106 and 108. These include: varying spacing between curved inner and outer electrodes; varying spacing between the grounds and the entrance and exit of the sectors; varying width of gap 120 compared to the distance between the sectors; varying distance between the sectors; inserting slits to limit the width of the ion beam; varying height of the sectors out of the plane of the ion flight path; partially closing the top and bottom of the sectors to improve field uniformity; placing additional ion lenses in the straight sections; placing a retarding or accelerating region in a straight section to change its effective length; varying lengths of the straight sections, i.e., making one longer and the other shorter but maintaining same overall length.

Electric sectors 106 and 108 are arranged with one end of one sector opposing one end of other sector to form S-shaped geometry defining S-shaped ion flight path, as shown in FIG. 1. In some embodiments of the present invention, ion source 102, straight sections 104 and 110, electric sectors 106 and 108, and detector 112 are arranged out of plane with respect to each other such that the ions traverse a helical path. In one embodiment of the present invention, ion source 102 is located below the plane of electric sectors 106 and 108, with straight sections 104 and 110 tilted up, such that the ions traverse a slightly helical path and arrive at detector 112 located above the plane of electric sectors 106 and 108. In a second embodiment of the present invention, ion source 102 is located above the plane of electric sectors 106 and 108, with straight sections 104 and 110 tilted down, such that the ions traverse a slightly helical path and arrive at detector 112 located below the plane of electric sectors 106 and 108. In other embodiments, sector 108 is tilted slightly out of the plane of sector 106 and section 104. Section 110 is then centered on the exit of sector 108, slightly above or below the plane depending on the direction of tilt of section 108. Tilting only sector 106 is equivalent to tilting sector 108 and rotating the entire apparatus.

Figure 5A:
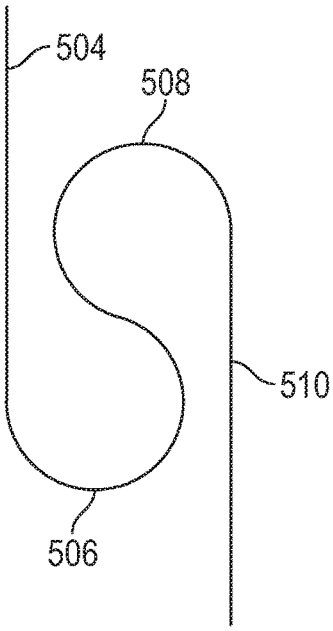
FIGS. 5A, 5B and 5C illustrate graphical representations of exemplary TOF mass spectrometer systems in accordance with embodiments of the present invention.
Figure 5B:
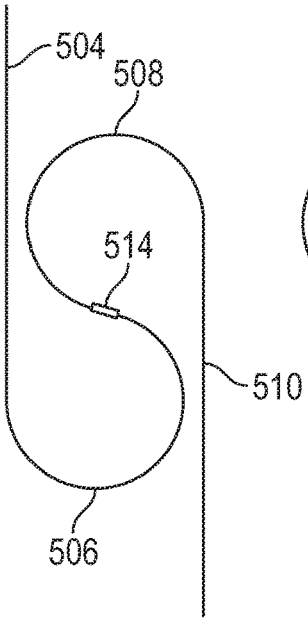
Figure 5C:
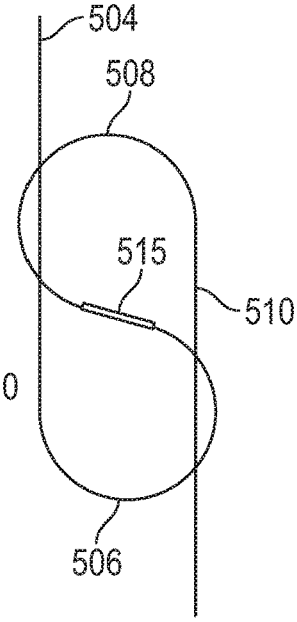

In other embodiments of the present invention, a straight section 114, as shown in FIG. 1, may be added between ends 106*d* and 108*d* of electric sectors 106 and 108, respectively. The length of straight section 114 may be varied up to a length wherein sectors 106 and 108 begin to overlap with straight sections 104 and 110. FIGS. 5A, 5B and 5C illustrate graphical representations of exemplary systems in accordance with embodiments of the present invention, with an entrance straight section 504, connecting to a curved electric sector 506, connecting to another, oppositely configured, curved electric sector 508, which connects to an exit straight sector 510, all of which provide the aforementioned ion flight paths therethrough, as set forth hereinabove. As shown in FIG. 5A, there is no added straight section, as described hereinabove. In FIG. 5B, there is a short straight section, generally designated by the reference numeral 514 added. Finally, in FIG. 5C, there is a long straight section, generally designated by the reference numeral 515, added between two electric sectors 506 and 508, respectively. As illustrated in FIG. 5C, when a long straight section 515 is included, the two electric sectors begin to overlap and interfere with the two straight sections. A short straight section 514 makes the design more compact, as shown in FIG. 5B.

Straight ion flight paths 104*a* and 110*a* are within straight sections 104 and 110, respectively. As shown in FIG. 1, entrance section 104 includes an inner electrode 104*b* and an outer electrode 104*c* to provide ground or other reference voltage. Entrance straight section 104 is arranged with end 104*d* opposing end 106*e* of curved electric sector 106 such that straight path 104*a* connects with curved path 106*a*. Gap 120 between end 104*d* of straight section 104 and end 106*e* of curved sector 106 is set for optimum performance. In one embodiment of the present invention, gap 120 is set to about 35 percent of the spacing between curved electrodes 106*b* and 106*c*. Exit straight section 110 is arranged with end 110*b* opposing end 108*e* of curved electric sector 108 such that curved path 108*a* connects with straight path 110*a*. In one embodiment of the present invention, the effective lengths of straight sections 104, 110 and 114 can be adjusted by setting at least one straight section at a voltage that is not the reference voltage. In another embodiment of the present invention, the effective lengths of straight sections 104, 110 and 114 can be adjusted by setting the voltages on inner electrodes 106*b*, 108*b*, and on outer electrodes 106*c*, 108*c* to be asymmetric with respect to the reference voltage. "Asymmetric" or "non-symmetric" voltages refers to the use of different voltages on inner and outer electrodes, for example, using +400 volts and −600 volts on the inner and outer electrodes instead of +500 volts and −500 volts, such that a potential different from the mid-potential is obtained. For example, the mid-potential of +400 and −600 is −100 rather than zero. In other embodiments of the present invention, straight sections 104, 110 and 114 can be fine-tuned to allow for optimal positioning of ion source 102, to account for manufacturing defects in straight sections 104, 110 and 114, and to compensate for any fringe fields.

In some embodiments of the present invention, straight section 104 further includes an adjustable section 116 for adjusting the effective length of straight section 104. If the effective length is not adjusted then the sum of lengths of entrance section 104, short straight section 114 and exit straight section 110 is equal to about the sum of the arc lengths of electric sectors 106 and 108. In other embodiments of the present invention, entrance section 104 includes lenses 118 for reducing divergence of ion beam caused by the spread of initial velocities of the ions perpendicular to the direction of acceleration or by the small-angle scatter at the openings of ion source 102. In some embodiments of the present invention entrance slit 122 is positioned between ion source 102 and entrance section 104 and exit slit 124 is positioned between exit section 110 and ion detector 112 to limit the ion beam to include ions having similar paths and to improve mass resolution.

Ions emitted as pulses from an ion source 102 pass through sectors 104, 106, 108 and 110, and travel toward ion detector 112. Ion detector 112 includes means for detecting ions and amplifying their signals. Exemplary ion detector include microchannel plates, continuous electron multipliers, discrete dynode electron multipliers, scintillation counters, Faraday cups, photomultiplier tubes, and the like. In some embodiments of the present invention ion detector 112 can include devices for recording ions detected therein. Exemplary devices for recording ions detected by ion detector 112 include a computer, memory, a hard disk or a SSD (Solid State Drive), a recording medium such as an IC card, a SD card or a DVD, and the like.

During typical operation of TOF mass spectrometer 100, ion source 102 generate and accelerate ions, which separate in entrance straight section 104, pass through gap 120, enter curved electric sector 106 via entry opening 106*e*, pass between paired electrodes 106*b* and 106*c* of curved electric sector 106, exit via opening 106*d* of electric sector 106, pass through straight section 114, enter electric sector 108 via entry opening 108*d*, pass between paired electrodes 108*b* and 108*c* of curved electric sector 108, enter straight section 110, and exit to reach detector 112.

Figure 2:
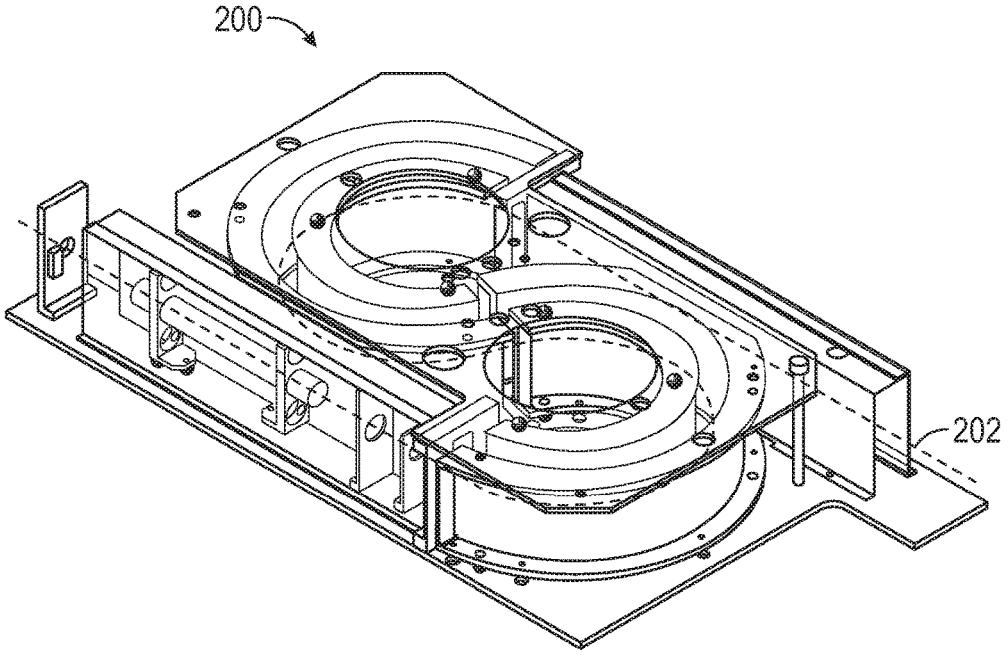
FIG. 2 illustrates an isometric view of a TOF mass spectrometer system in accordance with one embodiment of the present invention.

Pulsed ions generated from ion source 102 enter straight sector 104 along straight path 104*a*. Ions having a specific amount of energy, a specific mass number, and traversing along a central plane defined by straight path 202, as shown in FIG. 2, are referred to as reference ions. Ions that leave the central plane with its position, flight direction (or angle) and energy level being initially shifted from those of the reference ion, is considered to have spatial and temporal divergences from the reference ion flying along straight path 202 defined by a central plane. Embodiments of the present invention reduces such spatial and temporal divergence.

When ions traveling along straight path 104*a* enter sector 106 and pass between electrodes 106*b-c*, an electric field guide ions to travel in curved path 106*a* in electric sector 106. Outer and inner deflecting electrodes 106*b* and 106*c*, respectively, provide a deflecting electric field there between that deflects the ions to remain in curved path 106*a*. When ions traveling along curved path 106*a* exit sector 106 and enter sector 108, an electric field guide ions to travel in curved path 108*a* in electric sector 108. Outer and inner deflecting electrodes 108*b* and 108*c*, respectively, provide a deflecting electric field there between that deflects the ions to remain in curved path 108*a*. Outer and inner deflecting electrodes 106*b-c* and 108*b-c*, respectively, repel the ions by generating an electric field having a potential gradient whose polarity is the same as that of the ions. For positive ions, voltage of outer deflecting electrodes 106*c* and 108*c* is positive and voltage of inner deflecting electrodes 106*c* and 108*c* is negative in comparison with the reference voltage. For negative ions, voltage of outer deflecting electrodes 106*c* and 108*c* is negative and voltage of inner deflecting electrodes 106*c* and 108*c* is positive in comparison with the reference voltage. Consequently, ions begin to travel in S-shaped orbit formed by the curved paths 106*a* and 108*a*. The S-shape serves at least two functions: it folds the ion flight path into a compact arrangement and it reduces aberrations. The aberrations are reduced because of successive right- and left-handed turns (or vice versa). As shown by an exemplary embodiment in FIG. 1, ions travelling on the right-hand side, when looking down the ion beam, enter a right-hand sector closer to the inner electrode and enter a left-hand sector closer to the outer electrode. Therefore, aberrations that depend on whether one is close to the inner or outer electrode cancel because of symmetry provided by successive right- and left-handed turns (or vice versa).

Figure 6:
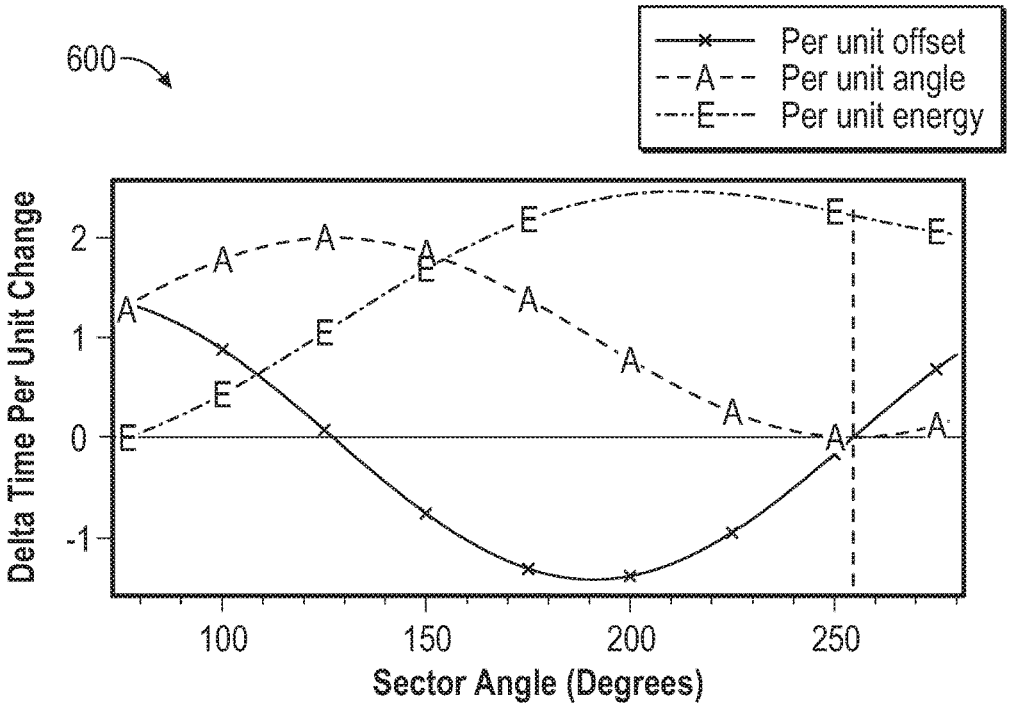
FIG. 6 illustrates changes in time taken by ions in traversing a single circular arc between exemplary cylindrical electrodes with varying turning angles.
Figure 7:
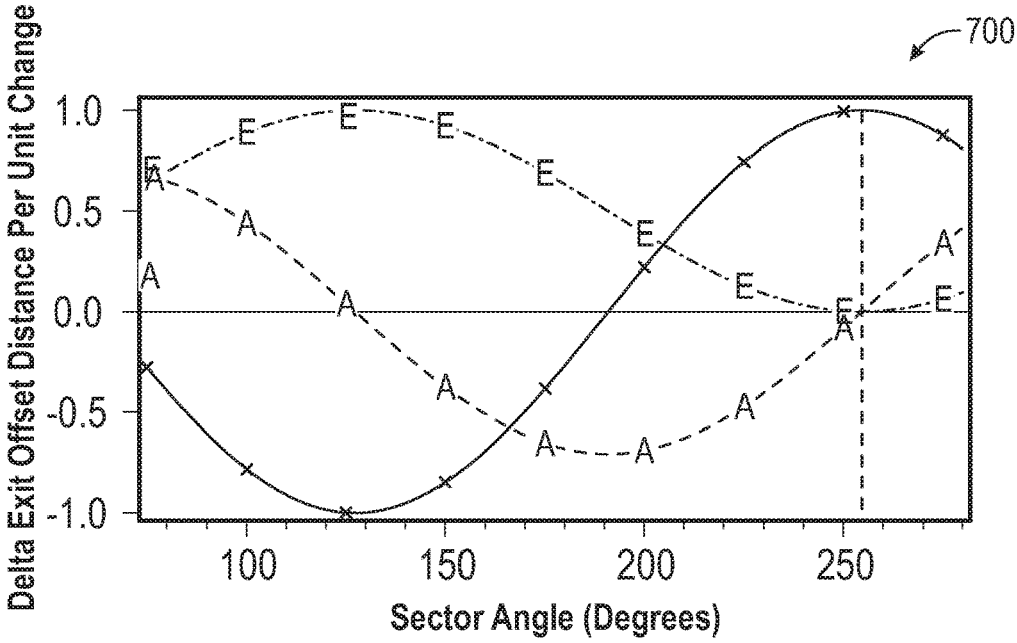
FIG. 7 illustrates offset in ion positions at the exit for ions traversing a single circular arc between exemplary cylindrical electrodes with varying turning angles.

FIGS. 6 and 7 provide exemplary illustration of how aberrations are reduced when ions traversing a single circular arc and how the reductions in aberrations are dependent on the angles of the circular arc, generally designated by the reference numerals 600 and 700, respectively. FIG. 6 illustrates first-order changes in time spent by ions traversing a single circular arc between exemplary cylindrical electrodes with varying turning angles. In the graphical illustration of FIG. 6, "E" denotes the change in time spent by ions having different energy along the centerline of a turn defined by a circular arc of cylindrical electrodes. Higher energy ions take longer time traversing a circular arc having an angle of about 254.5 degrees than lower energy ions in the arc. Conversely, high energy ions traversing straight sections take less time (they are faster) than lower energy ions. Thus, the 254.5 degrees turn compensates for necessary straight sections. "X" denotes ions entering the sector parallel to each other but displaced sideways. The time spent by ions traversing a turn having an angle of about 254.5 degrees is independent of the position at which the ions enter the sector. As an example, ions traversing the three paths shown in FIG. 1 spend the same amount of time. This desirable feature results in low aberration. "A" denotes ions entering the turn not parallel to each other. As with parallel ions, they take the same amount of time to go through the turn, resulting in low aberration. As shown in FIG. 6, 254.5 degrees is the only angle where curves "A" and "X" are both zero and "E" is greater than zero.

FIG. 7 illustrates offset in positions at the exit ("x" or side-to-side behavior) for ions traversing a single circular arc between exemplary cylindrical electrodes with varying turning angles. In the graphical illustration of FIG. 7, "X" curve shows that ion offset at the exit is equal to 1.0 when ions traverse a single circular arc having a turning angle of about 254.5 degrees, which shows a desirable feature that ions entering parallel to each other leave each sector the same distance apart as they entered. The "E" curve shows that ion offset at the exit is zero when ions traverse a single circular arc having a turning angle of about 254.5 degrees, which shows a desirable feature of minimum sideways offset between ions having different energies. Finally, the "A" curve shows that ion offset at the exit is zero when ions traverse a single circular arc having a turning angle of about 254.5 degrees, which shows a desirable feature of minimum sideways offset between ions that do not enter in paths that are parallel to each other. As discussed above, these desirable features are observed for electrodes that are sections of cylinders having a turning angle of about 254.5 degrees. However, for electrodes that are curved inward, but not cylindrical, optimum turning angle for observing the desirable features discussed above shift to angles greater than 254.5 degrees.

Ions exiting electric sector 108 enter straight path 110*a* defined by straight section 110. Ions then exit via outlet opening 110*c*, and are detected on arrival at ion detector 112. Flight path 202, as shown in FIG. 2, is the path of a reference ion, while flight paths 104*a*-110*a* are schematic representations of the paths taken by ions leaving ion source 102 with positions slightly displaced from the reference ion.

Figure 8:
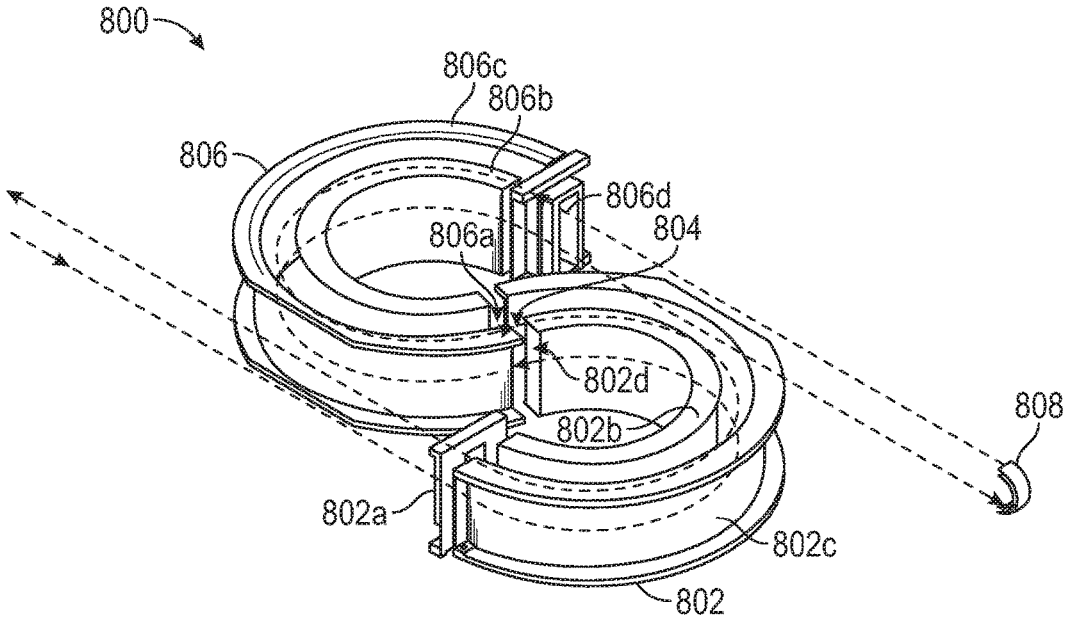
FIG. 8 illustrates a system for expressing an ion path in a TOF mass spectrometer in accordance with an alternate embodiment of the present invention.

Embodiments of the present invention can be modified to provide multiple passes through single S-shaped curved electric sectors arrangement. In one embodiment of the present invention, a system for expressing an ion path in a TOF mass spectrometer can be modified to provide at least two passes through single S-shaped curved electric sectors arrangement. FIG. 8 illustrates an exemplary system for expressing an ion path in a TOF mass spectrometer, generally designated 800, which comprises alternate embodiments of the present invention. TOF mass spectrometer system 800 can provide at least two passes through single S-shaped curved electric sectors arrangement. During typical operation of TOF mass spectrometer system 800, ions generated and accelerated in an ion source enter curved electric sector 802 via entry opening 802*a*, pass between paired electrodes 802*b* and 802*c* of curved electric sector 802, exit via opening 802*d* of electric sector 802, pass through straight section 804, enter electric sector 806 via entry opening 806*a*, pass between paired electrodes 806*b* and 806*c* of curved electric sector 806, exit via opening 806*d* of electric sector 806 to enter a turn-around section 808, which is configured to reverse the ions exiting from the opening 806*d*, turning the ion stream around to be parallel to the path taken by the ions before entering the turn-around section 808. The ions thus reflected re-enter electric sector 806 via opening 806*d* and pass through electric sector 806, straight sector 804 and electric sector 802 before exiting via opening 802*a* to reach a detector. Thus, the ions traverse a path twice as long within a single path defined by the S-shaped arrangement of electric sectors 802 and 806. TOF mass spectrometry system in accordance with such an alternative embodiment of the present invention maintains an optimum mass resolution and minimum spatial spread in the beam.

Systems in accordance with embodiments of the present invention can be applied in various ways. System and methods in accordance with one or more embodiments of the present invention can be utilized by industries where portability of mass spectrometers is desired. TOF mass spectrometers with a compact, high-resolution design are desirable for measurements of biomolecules, aerosol chemistry with laser or thermal vaporization, ion mobility spectrometers, proton transfer and other chemical ionization spectrometers, mass spectrometers following liquid or gas chromatographs, electrospray mass spectrometers, and other applications.

Systems in accordance with embodiments of the present invention has several advantages over previous TOS mass spectrometers. More particularly, geometry of the system in accordance with embodiments of the present invention has several advantages over previous electrostatic sector designs: a) it provides a compact total flight length; b) the choice of deflection angle of about 255 degrees reduces aberrations in the ion optics; c) the double sector with one turn in opposite direction of the other turn cancels a number of aberrations; d) allows for the entrance and exit ion beams to be parallel, which is not the case with single sector designs; and e) adequate separation of ion source and detector.

It is thought that the TOF mass spectrometer system of the present invention and many of its attendant advantages will be understood from the foregoing description and it will be apparent that various changes may be made in the form, construction arrangement of parts thereof without departing from the spirit and scope of the invention or sacrificing all of its material advantages, the form hereinbefore described being merely a preferred or exemplary embodiment thereof.

I claim:

1. A system for expressing an ion path in a time-of-flight mass spectrometer, comprising:

a first straight sector defining a first straight ion flight path, said first straight sector having a first sector entrance and a first sector outlet, wherein the first sector entrance is positioned to receive a plurality of ions along the first straight ion flight path;

a first electric sector defining a first curved ion flight path, said first electric sector having a first electric sector entrance and a first electric sector outlet, wherein the first electric sector entrance is positioned opposing the first straight sector outlet and to receive the plurality of ions from the first straight sector outlet along the first curved ion flight path;

a second electric sector defining a second curved ion flight path, said second electric sector having a second electric sector entrance and a second electric sector outlet, wherein the second electric sector entrance is positioned opposing the first electric sector outlet and to receive the plurality of ions exiting from the first electric sector outlet along the second curved ion flight path; and a turn-around section, wherein said turn-around section reverses the path of said plurality of ions exiting said second electric sector outlet, wherein a first slit is positioned at the first sector entrance and a second slit is positioned at the second sector outlet, and wherein the first and second slits limit the plurality of ions to comprise ions having substantially identical ion flight paths.

2. The system according to claim 1, further comprising:

a second straight sector defining a second straight ion flight path, said second straight sector having a second sector entrance and a second sector outlet, wherein the second sector entrance is positioned to receive the plurality of ions from the second electric sector outlet along the second straight ion flight path.

3. The system according to claim 2, further comprising:

an ion source for generating the plurality of ions; and an ion detector for detecting the plurality of ions exiting the second straight sector, wherein the ion detector is positioned to receive the plurality of ions from the second straight sector outlet.

4. The system according to claim 1, further comprising:

a third straight sector defining a third straight ion flight path, said third sector having a third sector entrance and a third sector outlet, wherein the third sector entrance is positioned to receive ions from the first electric sector outlet along the third straight flight path, and wherein the second electric sector entrance is positioned to receive the plurality of ions exiting from the third straight sector outlet along the second curved ion flight path.

5. The system according to claim 1, wherein the first electric sector comprises a first inner deflecting electrode and a first outer deflecting electrode, wherein the first electric sector comprising the first inner deflecting electrode and the first outer deflecting electrode define a first deflection angle of about 254.5 degrees.

6. The system according to claim 1, wherein the second electric sector comprises a second inner deflecting electrode and a second outer deflecting electrode, and wherein the second electric sector comprising the second inner deflecting electrode and the second outer deflecting electrode define a second deflection angle of about 254.5 degrees.

7. The system according to claim 1, wherein the second electric sector is positioned to define the second curved ion flight path opposing the first curved ion flight path.

8. The system according to claim 7, wherein the first and the second curved ion flight paths define an S-shaped ion flight path.

9. The system according to claim 1, wherein the first straight sector further comprises an adjustable sector for adjusting effective length of the first straight sector.

10. The system according to claim 1, further comprising:

a plurality of optical lenses positioned at the first sector entrance for reducing divergence of the plurality of ions generated from the ion source.

11. The system according to claim 1, wherein an ion source, the first and second straight sectors, the first and second electric sectors, and an ion detector are positioned to constrain the plurality of ions to traverse a helical ion flight path.

12. The system according to claim 1, wherein the plurality of ions are generated as a pulse of ions.

13. A system for expressing an ion path in a time-of-flight mass spectrometer, comprising:

a plurality of field free sectors defining a plurality of straight ion flight paths, wherein each field free sector comprises a sector entrance and a sector outlet, wherein the at least one of the plurality of field free sector entrance is positioned to receive a plurality of ions along the at least one of the plurality of straight ion flight path;

at least two electric sectors positioned to define a first and a second curved ion flight paths, wherein the first curved ion flight path opposes the second curved ion flight path to define a S-shaped ion flight path, wherein the at least two electric sectors are positioned to enable the plurality of ions to travel along the S-shaped ion flight paths; and a turn-around section, wherein said turn-around section reverses the path of said plurality of ions exiting said S-shaped ion flight path back through said S-shaped ion flight path, wherein a first slit is positioned at the sector entrance and a second slit is positioned at the sector outlet, and wherein the first and second slits limit the plurality of ions to comprise ions having substantially identical ion flight paths.

14. The system according to claim 13, further comprising:

an ion source for ionizing chemical compounds to form the plurality of ions; and an ion detector for detecting the plurality of ions that have traveled along the plurality of straight ion flight paths and the first and second curved ion flight paths, wherein the ion detector is positioned to receive the plurality of ions exiting from the at least one of the plurality of free field sector outlets.

15. The system according to claim 13, wherein each of the at least two electric sectors comprises an electric sector entrance and an electric sector outlet.

16. The system according to claim 13, wherein each of the at least two electric sectors comprises an inner deflecting electrode and an outer deflecting electrode.

17. The system according to claim 13, further comprising:

a first optical element disposed at the sector entrance of the at least one of the plurality of field free sector entrance receiving the plurality of ions and a second ion optical element disposed at the sector outlet exiting the ions from the at least one of the plurality of free field sector outlets.

18. The system according to claim 13, further comprising:

at least one electrode for modifying potential experienced by the ions entering the at least one of the plurality of field free sectors.

19. The system according to claim 13, further comprising:

a device for recording a time-of flight spectrum of the detected ions.

20. A method for expressing an ion path in a time-of-flight mass spectrometer, comprising:

injecting a plurality of ions on a first straight ion flight path into a mass spectrometer along a first straight sector, said first straight sector having a first sector entrance and a first sector outlet, wherein the first sector entrance is positioned to receive said plurality of ions along the first straight ion flight path;

curving, by a first electric sector, said plurality of ions into a first curved ion flight path, said first electric sector having a first electric sector entrance and a first electric sector outlet, wherein the first electric sector entrance is positioned opposing the first straight sector outlet and to receive the plurality of ions from the first straight sector outlet along the first curved ion flight path;

curving, by a second electric sector, said plurality of ions into a second curved ion flight path, said second electric sector having a second electric sector entrance and a second electric sector outlet, wherein the second electric sector entrance is positioned opposing the first electric sector outlet and to receive the plurality of ions exiting from the first electric sector outlet along the second curved ion flight path, and wherein the first curved ion flight path opposes the second curved ion flight path to generally define a S-shaped ion flight path; and reversing, in a turn-around section, the path of said plurality of ions exiting said second electric sector outlet, wherein a first slit is positioned at the first electric sector entrance and a second slit is positioned at the second electric sector outlet, and wherein the first and second slits limit the plurality of ions to comprise ions having substantially identical ion flight paths.

21. The method according to claim 20, further comprising:

ejecting said plurality of ions into a second straight sector along a second straight ion flight path, said second straight sector having a second sector entrance and a second sector outlet, wherein the second sector entrance is positioned to receive the plurality of ions from the second electric sector outlet along the second straight ion flight path.

* * * * *